US010947776B1

(12) United States Patent
Lentowich et al.

(10) Patent No.: US 10,947,776 B1
(45) Date of Patent: Mar. 16, 2021

(54) TENSIONED SHEET WALL SYSTEM FOR A BUILDING

(71) Applicant: G&B Portable Fabric Buildings Inc., Cooks Creek (CA)

(72) Inventors: Alexander Lentowich, Cooks Creek (CA); Ryan Hunter, Cooks Creek (CA)

(73) Assignee: GNB GLOBAL INC., Cooks Creek (CA)

( * ) Notice: Subject to any disclaimer, the term of this patent is extended or adjusted under 35 U.S.C. 154(b) by 0 days.

(21) Appl. No.: 16/672,712

(22) Filed: Nov. 4, 2019

(51) Int. Cl.
*E06B 9/06* (2006.01)
*E04G 5/12* (2006.01)
*E04G 21/28* (2006.01)

(52) U.S. Cl.
CPC ..... *E06B 9/0692* (2013.01); *E04G 5/12* (2013.01); *E04G 21/28* (2013.01)

(58) Field of Classification Search
CPC ..... E06B 9/0692; E04G 5/12; E04G 21/28
See application file for complete search history.

(56) References Cited

U.S. PATENT DOCUMENTS 3,805,816 A 4/1974 Nolte
5,207,256 A * 5/1993 Kraeutler ..... E06B 9/063 160/264
5,450,889 A * 9/1995 Jones ..... A47H 15/02 160/330
5,613,543 A 3/1997 Walton
6,116,319 A * 9/2000 Simon ..... E06B 9/063 160/264
10,145,121 B1 12/2018 Devitt
2001/0017193 A1* 8/2001 Duric ..... E06B 9/44 160/321
2012/0241108 A1* 9/2012 Marszalek ..... E06B 9/0692 160/264

* cited by examiner

*Primary Examiner* — Patrick J Maestri
(74) *Attorney, Agent, or Firm* — Ryan W. Dupuis; Kyle R. Satterthwaite; Ade & Company Inc.

(57) ABSTRACT

A wall system for forming a weather enclosure across a building opening in the frame of a building includes a flexible sheet of flexible material, a first rigid frame member secured across a first end of the flexible sheet, and a second rigid frame member secured across the flexible sheet in proximity to an opposing second end of the sheet. The first rigid frame remember is fixedly mounted on the building frame. A tensioning assembly is operatively connected between the second rigid frame member and the building frame so as to apply tension in the longitudinal direction to a portion of the flexible sheet. The tensioning between rigid frame members spanning across opposing ends of the sheet ensures that the sheet can be supported under significant tension throughout the sheet to enable the sheet to withstand considerable wind and precipitation loads.

19 Claims, 8 Drawing Sheets

TENSIONED SHEET WALL SYSTEM FOR A BUILDING

FIELD OF THE INVENTION

The present invention relates to a wall system in which flexible sheet material is tensioned to span across the frame of a building, for example to provide a temporary weather enclosure supported on the frame of a building while the building is under construction.

BACKGROUND

During the construction of large commercial buildings, it is common practice to initially erect a building frame comprised of posts and beams and roof trusses followed by subsequent mounting of rigid panels of various types to form permanent walls of the building. While assembling the building frame and/or preparing the building for mounting wall panelling onto the frame, it is often desirable to provide a weather enclosure about the building to allow heating of the interior space of the building. Some heating of the interior space may be required to assist in curing of various materials such as concrete, or for comfort of construction workers within the building space. As a temporary means of forming a weather enclosure, it is common practice to support sheets of plastic type material directly on the building frame or on scaffolding surrounding a building frame. The plastic material however may be required to span large distances on large commercial buildings and the plastic material is typically not well supported for withstanding wind loads or loads from precipitation and the like such that the panels become torn and require replacement even during short-term use for construction.

U.S. Pat. No. 5,613,543 by Walton and U.S. Pat. No. 3,805,816 by Nolte, and WO97/48863 by Nylander disclose various examples of a temporary protective covering used in construction. In each instance however, only small sheets are provided for spanning short distances with minimal means of retaining the sheets. Accordingly, the coverings are not well-suited to withstand wind loads and precipitation loads in large building applications.

SUMMARY OF THE INVENTION

According to one aspect of the invention there is provided a wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges;

a retainer member comprising a first frame member arranged to be secured to the first end of the flexible sheet so as to span the width of the flexible sheet and arranged to mount onto the building frame in fixed relation thereto along a first side of the building opening;

a tension member comprising a second frame member arranged to be secured to the flexible sheet in proximity to the second end of the flexible sheet so as to span the width of the flexible sheet; and a tensioning assembly arranged to be fixed onto the building frame along a second side of the building opening opposite from the first side of the building opening, the tensioning assembly being operatively connected to the tension member so as to apply tension in the longitudinal direction to a portion of the flexible sheet between the retainer member and the tension member.

The combination of a first frame member spanning the full width at the first end of a flexible sheet together with a second frame member spanning the full width at the second end of the sheet together with means to tension the sheet longitudinally between the frame members ensures that the flexible sheet can be supported under significant tension throughout the sheet in a manner that enables the sheet to withstand considerable wind loads. The flexible sheet typically comprises a high-quality fabric material with abrasion resistance and tear resistant properties by providing an enhanced coating on a woven plastic fibers sheet. The flexible sheets thus offer safer building envelopes which protect buildings and materials and equipment within the temporary building structure from harsh and unpredictable weather.

The system may further include a pocket formed on the flexible sheet extending laterally across the width of the flexible sheet and receiving the tension member therein.

Preferably the second frame member forming the tension member is a rigid tube extending laterally across the width of the flexible sheet.

The tension member in the illustrated embodiment is secured to the flexible sheet at a mounting location spaced longitudinally inwardly from the second end of the flexible sheet so as to define an end portion of the flexible sheet extending longitudinally between the mounting location and the second end of the flexible sheet which is not tensioned by the tensioning assembly. When using multiple flexible sheets to span respective levels of a building, the end portion can span an exterior of the building enclosure from the respective upper tensioned sheet to join the top edge of a lower tensioned sheet therebelow and form a continuous weather barrier.

Preferably the end portion of the flexible sheet spans a length of the tensioning assembly in the longitudinal direction of the flexible sheet between the tension member and a mounting portion of the tensioning assembly that is arranged to be secured to the building frame.

The system may further include a second retainer member comprising a third frame member of the system that is arranged to be secured to the second end of the flexible sheet so as to span the width of the flexible sheet and is arranged to mount onto the building frame in fixed relation thereto along the second side of the building opening.

When provided in combination with a second sheet arranged to be supported longitudinally in series with the flexible sheet, the second retainer member preferably commonly secures both the second end of the flexible sheet and a first end of the second sheet therein.

The tensioning assembly may comprise at least one winch arranged to be operatively connected between the building frame and the tension member. In further embodiments, various means to adjustably secure the tension member relative to the second side of the building opening can be used such as screw rods, turnbuckles, pivoting linkages, buckles, and the like such that tightening and/or shortening of the tensioning assembly between the tension member and a mounting portion on the second side of the building opening pulls the tension member towards the second side of the building opening to tension the flexible sheet.

Preferably a plurality of winches (or other adjustable coupling mechanisms between the tension member and the second side of the building opening) are provided at laterally spaced apart positions along the tension member.

In some instances, the flexible sheet comprises a plurality of sheet sections releasably joined in series with one another using releasable fasteners such that each sheet section spans a full length of the flexible sheet in the longitudinal direction between the opposing first and second ends of the flexible sheet and only spans a portion of the width of the flexible sheet in the lateral direction. In this instance the tension member may comprise a single frame member spanning the width of the flexible sheet across the plurality of sheet sections, and/or the retainer member may comprise a single frame member spanning the width of the flexible sheet across the plurality of sheet sections.

In further embodiments, additional flexible sheets may span laterally adjacent building openings in the building frame. In this instance, adjacent flexible sheets can be joined at their side edges by various types of releasable fastening, for example hook and loop fasteners, zippers, laces through grommet openings, and the like.

The first end of the flexible sheet may comprise a bead spanning laterally across the width of the sheet and the retainer member may comprise a channel adapted to retain the bead therein.

When the tensioning assembly is readily releasable from the sheet, the retainer member may comprise a track spanning the width of the sheet and supporting one or more carriage assemblies for rolling movement in a lateral direction along the track, said one or more carriage assemblies being arranged to support the first end of the sheet thereon such that the sheet is laterally movable in the lateral direction together with rolling movement of said one or more carriage assemblies along the retainer member.

The system may further include a rigid railing member connected to the flexible sheet to extend in the lateral direction across the flexible sheet at an intermediate location between the first end of the flexible sheet and a connection of the tension member on the flexible sheet.

According to a second aspect of the present invention there is provided a wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges;

a retainer member comprising a track arranged to mount onto the building frame in fixed relation thereto along a first side of the building opening so as to span the width of the flexible sheet one or more carriage assemblies supported for rolling movement in a lateral direction along the track, said one or more carriage assemblies being arranged to support the first end of the sheet thereon such that the sheet is laterally movable in the lateral direction together with rolling movement of said one or more carriage assemblies along the retainer member;

a tension member comprising a second frame member arranged to be secured to the flexible sheet in proximity to the second end of the flexible sheet so as to span the width of the flexible sheet; and a tensioning assembly arranged to be fixed onto the building frame along a second side of the building opening opposite from the first side of the building opening, the tensioning assembly being operatively connected to the tension member such that (i) the tensioning assembly is arranged to apply tension in the longitudinal direction to a portion of the flexible sheet between the first end of the flexible sheet and the tension member and (ii) the tensioning assembly is readily releasable from the sheet.

The use of carriage assemblies within a track for supporting a selectively tensioned sheet across a building opening allows the building opening to be used temporarily as a doorway when the tensioning assembly is released.

According to a further aspect of the present invention there is provided a wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges;

a first frame member arranged to be secured to the flexible sheet in proximity to the first end of the flexible sheet so as to span the width of the flexible sheet;

a second frame member arranged to be secured to the flexible sheet in proximity to the second end of the flexible sheet so as to span the width of the flexible sheet;

the first and second frame members being arranged to mount onto the building frame in fixed relation thereto along opposing first and second sides of the building opening such that the flexible sheet is under tension in the longitudinal direction between the first and second frame members; and a rigid railing member connected to the flexible sheet to extend in the lateral direction across the flexible sheet at an intermediate location between a connection of the flexible sheet to the first frame member and a connection of the flexible sheet to the second frame member.

The rigid railing member provides a safety barrier during building construction to protect against workers falling from upper levels of a building under construction. When the railing member is incorporated into a tensioned fabric wall system that provides a weather enclosure, the tensioned wall fabric reinforces the function of the railing member as a safety railing, while the railing member reinforces the function of the tensioned sheet as a temporary wall enclosure, particularly when the railing member and the sheet are tensioned in transverse directions relative to one another.

The rigid railing member is preferably received within a pocket formed on the flexible sheet. The pocket preferably receives the rigid railing member therein at a location spaced from a plane of the flexible sheet.

The pocket may include a plurality of access openings formed therein at laterally spaced apart positions in alignment with the rigid railing member such that the rigid railing member is exposed and thus arranged to be readily grasped in a hand of a user at each access opening.

The rigid railing member preferably receives a flexible cable extending through the rigid railing member in the lateral direction of the flexible sheet between opposing railing mounts, the railing mounts being arranged to be supported on the building frame so as to support the flexible cable under tension in the lateral direction transversely to the longitudinal direction of the sheet.

BRIEF DESCRIPTION OF THE DRAWINGS

Various embodiments of the invention will now be described in conjunction with the accompanying drawings in which.

In the drawings like characters of reference indicate corresponding parts in the different figures.

DETAILED DESCRIPTION

Figure 1:
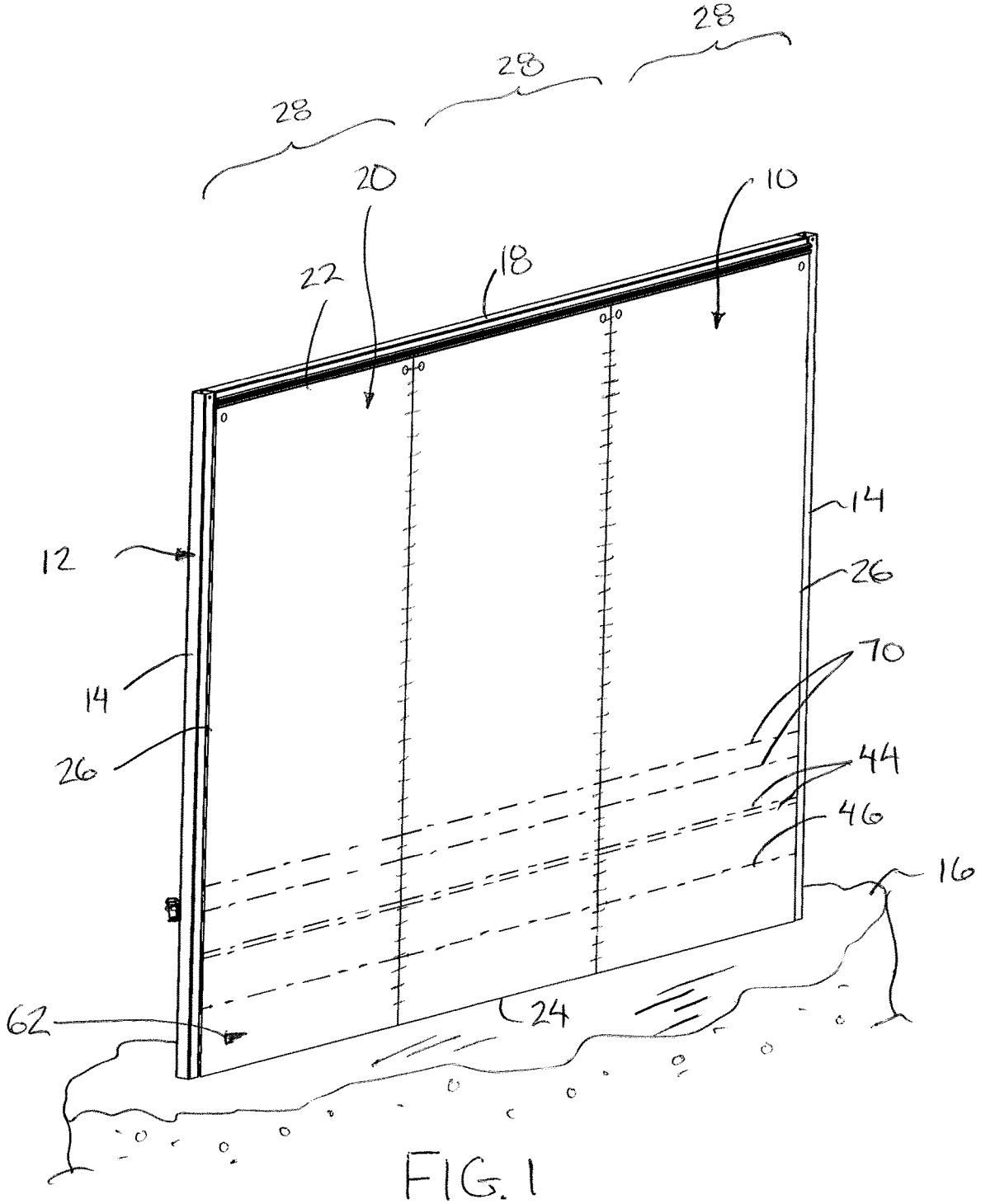
FIG. 1 is a perspective view of an exterior side of the wall system according to a first embodiment.
Figure 2:
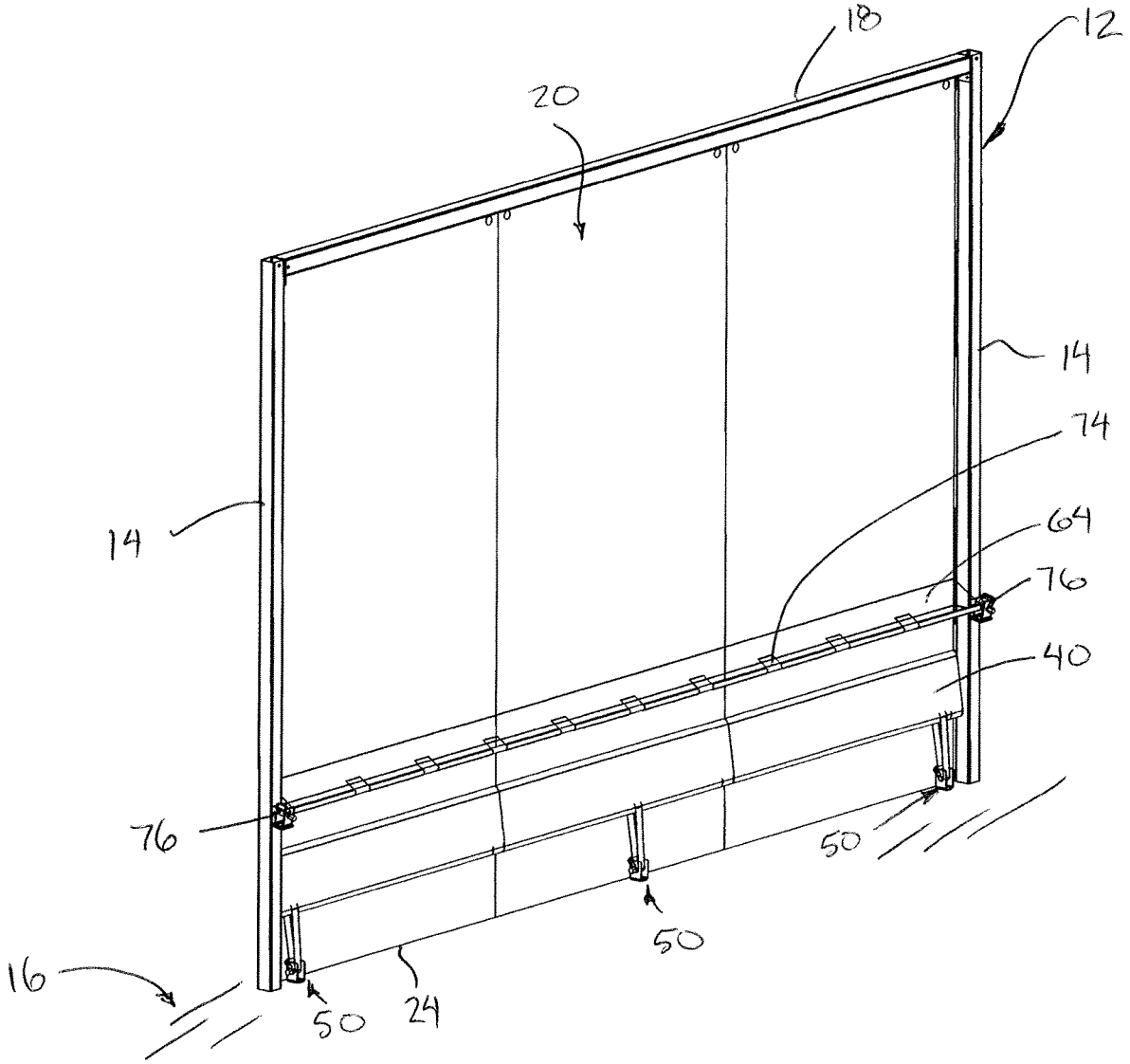
FIG. 2 is a perspective view of an interior side of the wall system according to the first embodiment of FIG. 1.
Figure 3:
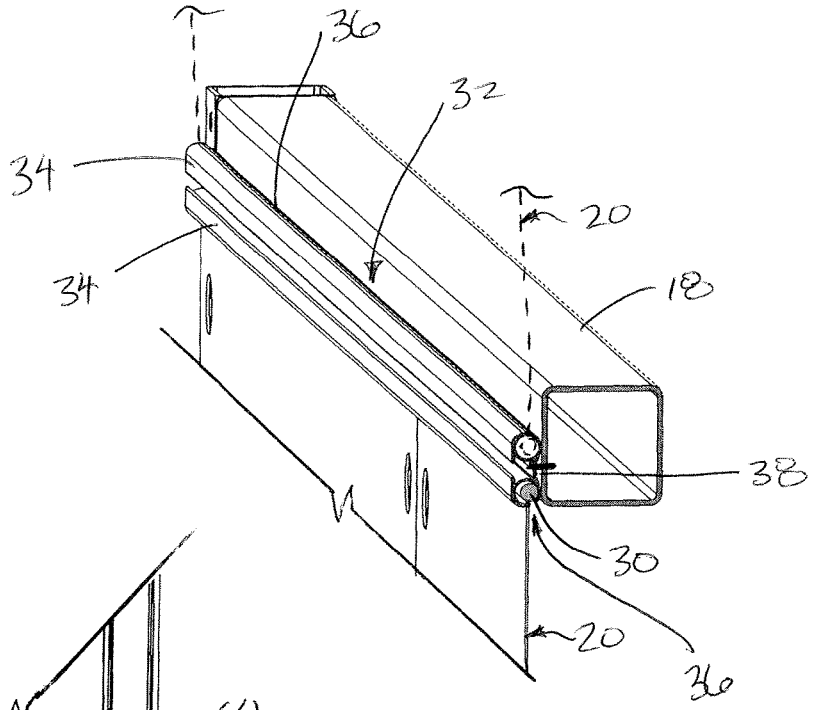
FIG. 3 is a partly sectional view of the top end of the flexible sheet retained within the retainer member, showing the bottom end of an additional flexible sheet optionally retained within the same retainer member according to the first embodiment of FIG. 1.
Figure 4:
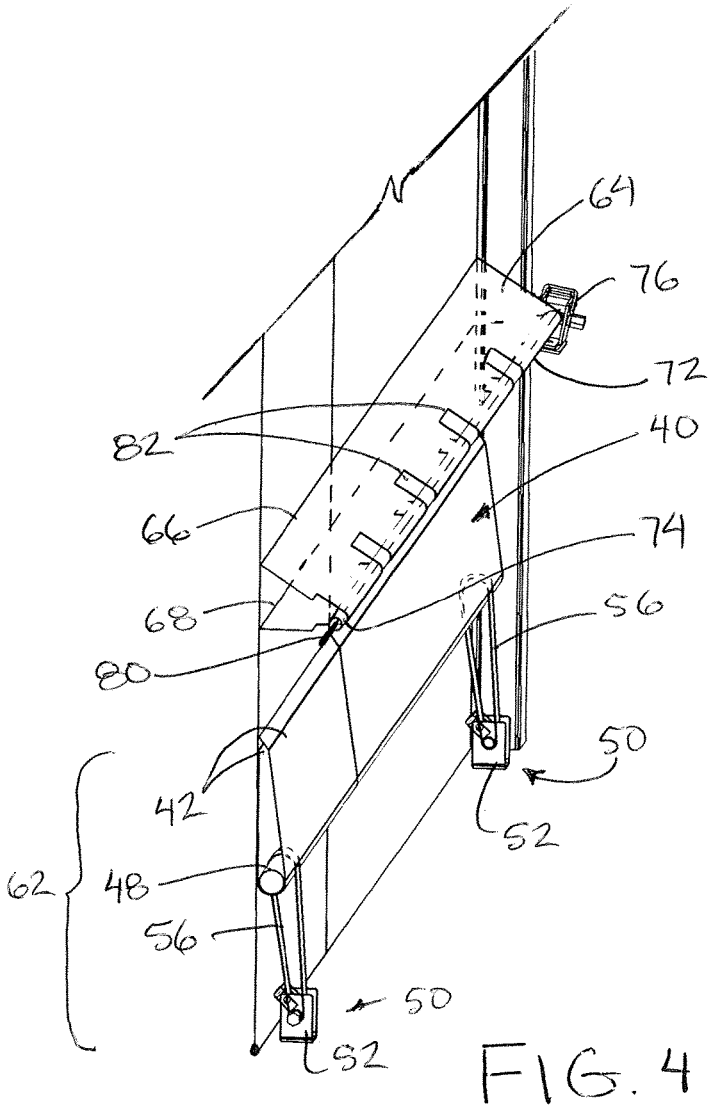
FIG. 4 is a partly sectional perspective view of the tensioning assemblies and the railing assembly of the wall system according to the first embodiment of FIG. 1.
Figure 5:
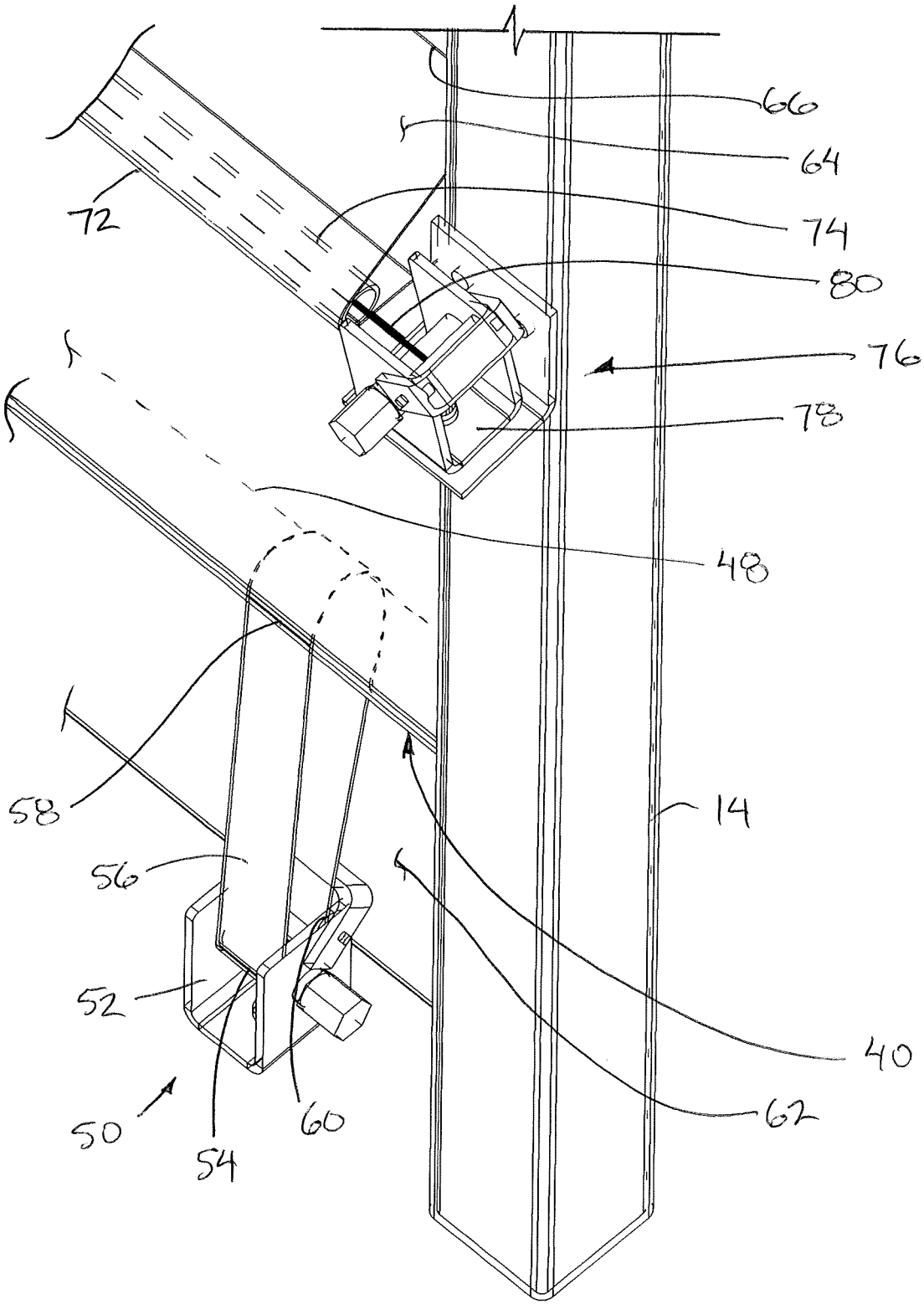
FIG. 5 is an enlarged perspective view of one of the tensioning devices of the flexible sheet and the tensioning mechanism for the railing assembly of the wall system according to the first embodiment of FIG. 1.
Figure 6:
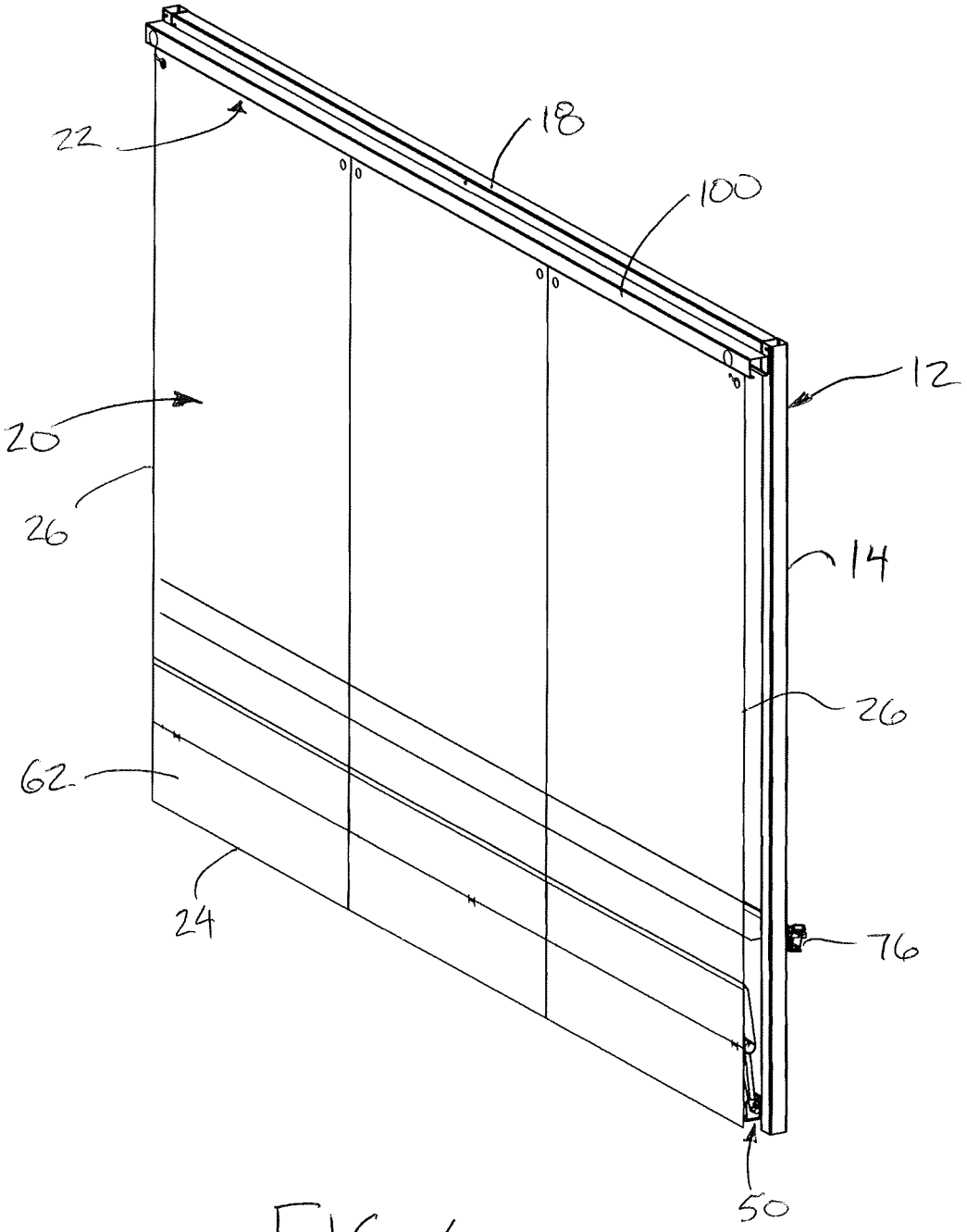
FIG. 6 is a perspective view of an exterior side of the wall system according to a second embodiment.
Figure 7:
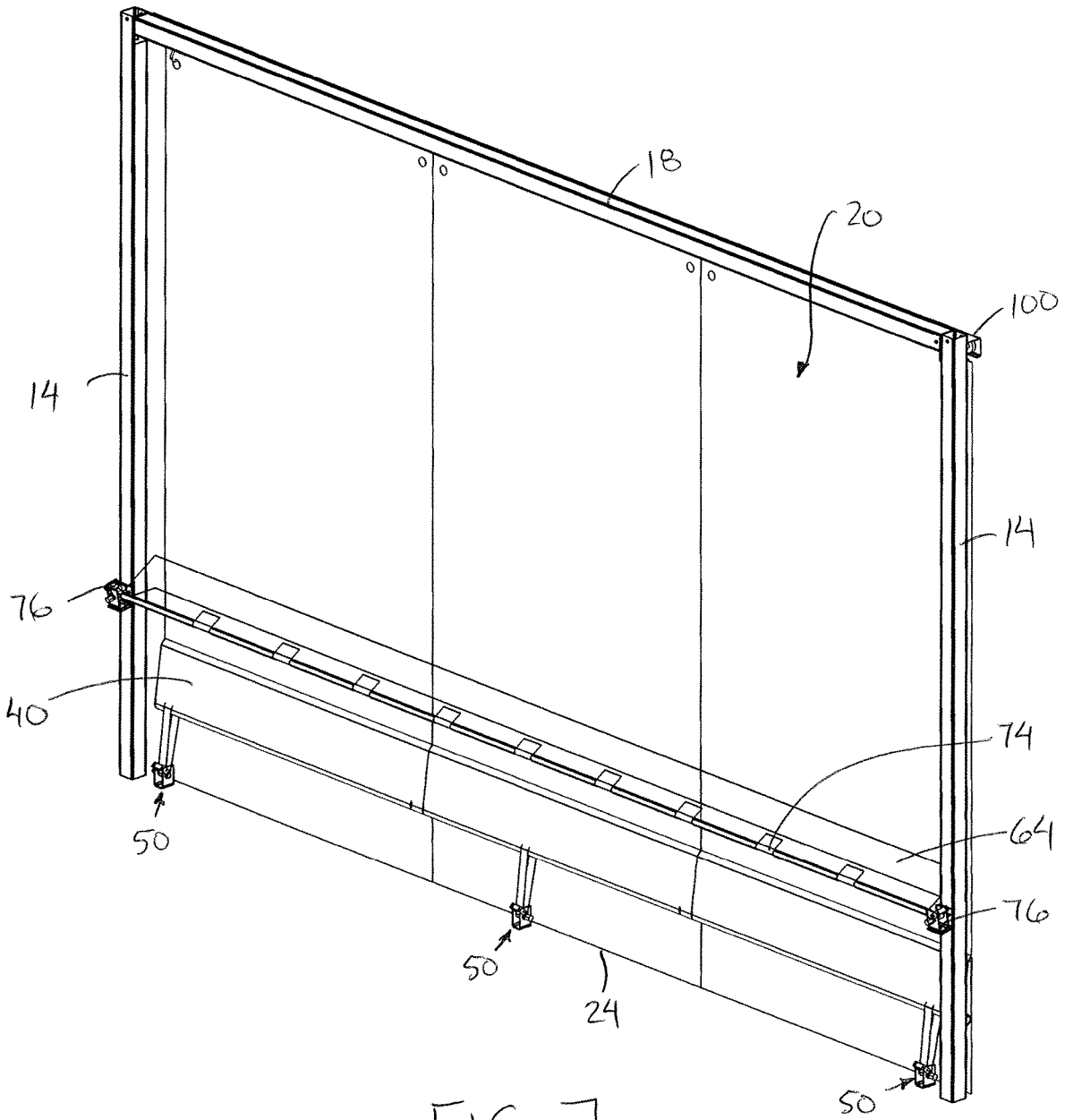
FIG. 7 is a perspective view of an interior side of the wall system according to the second embodiment of FIG. 6.
Figure 8:
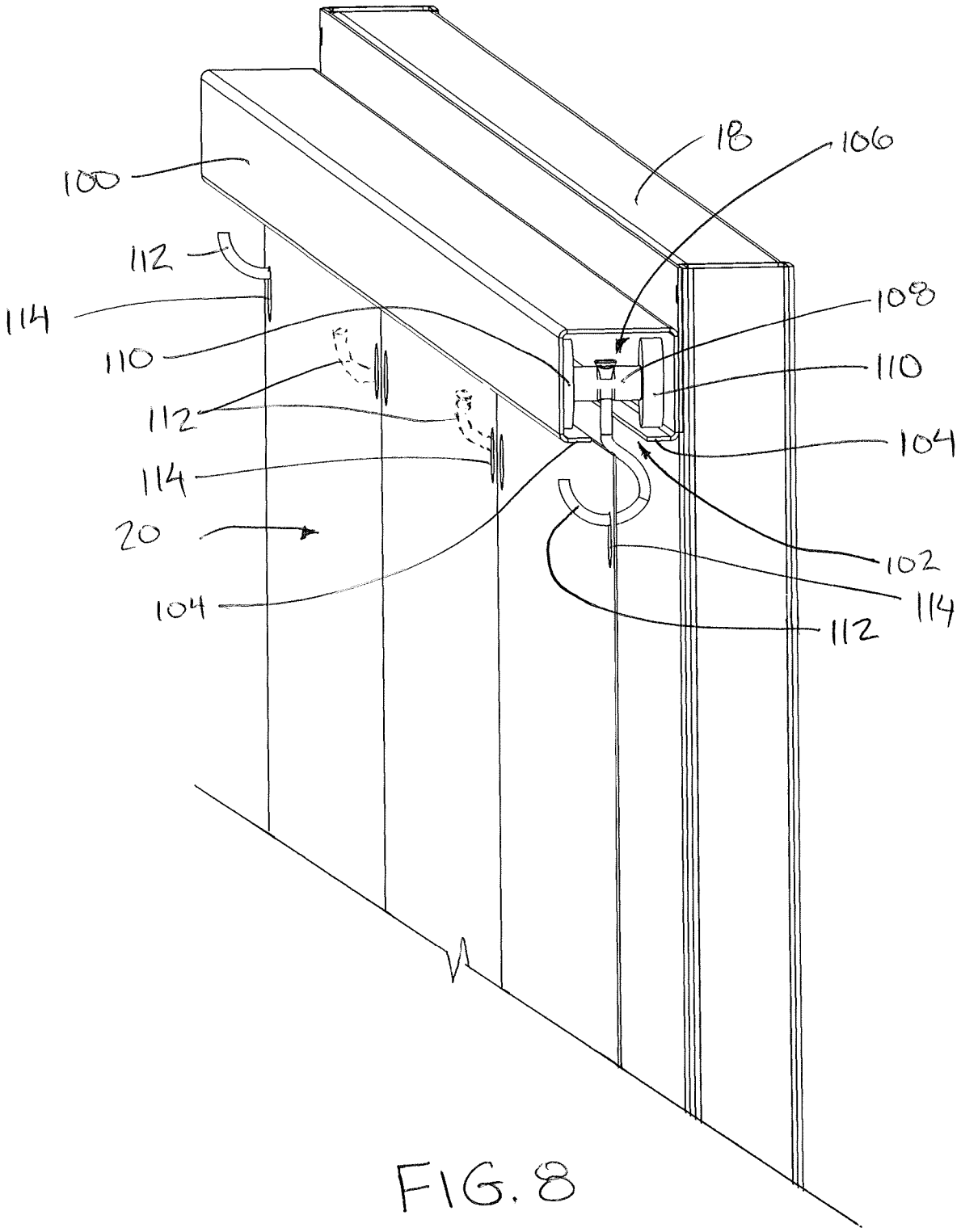
FIG. 8 is a partly sectional view of the top end of the flexible sheet secured relative to the retainer member when the flexible sheet is supported for lateral sliding movement as a temporary door.

Referring to the accompanying figures there is illustrated a fabric wall system generally indicated by reference numeral 10. The system 10 is particularly suited for use in forming a temporary or semi-permanent weather enclosure about the frame 12 of a building, for example during construction of the building before rigid wall panels are installed on the frame.

A typical commercial building frame 12 includes a plurality of posts spaced apart along each wall of the building with each wall further including a header spanning across the posts at the elevation of each floor and the roof of the building for supporting floor beams and roof trusses on the headers. The posts typically extend upwardly from a foundation which may comprise additional framing or a concrete pad for example that forms the base of the building frame. The building frame 12 defines a plurality of building openings in which each building opening includes a perimeter that is bound at laterally opposing sides by a respective post 14, is bound by framing or a foundation 16 at the bottom side of the opening, and is bound by a header 18 at the top side of the opening. At upper levels of the building frame, the bottom of the perimeter of each building opening is typically bound by an additional header 18.

The wall system 10 according to the present invention generally uses a flexible fabric sheet 24 spanning the building opening under tension. The fabric sheet typically comprises a flexible material, for example plastic fibers which are woven together and/or coated so as to define either (i) a single ply of material, or (ii) when insulation is desired, two plies of material with additional insulating layers optionally provided therebetween if desired. The coating provides abrasion and heat resistance, and ultraviolet resistance, while ensuring that the sheet 20 remains flexible.

The fabric sheet 24 spans in a longitudinal direction a full length of the sheet between a first end 22 at the top end and a second end 24 at the bottom end of the sheet. The sheet also spans in a lateral direction perpendicular to the longitudinal direction across a full width between two opposing side edges 26.

Each building opening may be covered by a fabric sheet 20 comprising a single continuous sheet of material or a plurality of sheet sections 28 which are joined together. In the illustrated embodiment, the fabric sheet 20 is formed of multiple sheet sections 28 connected laterally in series with one another such that each sheet section spans the full height between the top end 22 and the bottom end 24 while only spanning a part of the width in the lateral direction between the opposing side edges 26. The seams between adjacent sheet sections can be joined by various means including heat welding, gluing or stitching if a permanent seam is desired, or use of hook and loop fasteners, zippers, or laces tied through grommets and the like if it is desirable to subsequently separate the sheet sections from one another.

At the top end 22 of the sheet, an elongate strand of material, for example a nylon rope is embedded within the plastic material forming the body of the fabric sheet 20 so as to form a bead 30 of increased thickness relative to the remainder of the sheet, extending laterally across the full width of the flexible sheet at the top edge thereof.

A similar bead 30 may also be provided along the bottom edge when the flexible sheet is used in a multi-level application where it is desirable for the bottom edge of the sheet to be joined continuously with the top edge of another sheet therebelow.

Turning now more particularly to the first embodiment of the system 10 as shown in FIGS. 1 through 5, the system includes a retainer member 32 comprising a rigid frame member which is arranged to be fastened to the header 18 along the top side of the building opening so that the retainer member 32 spans the full width of the building opening and the full width of the corresponding flexible fabric sheet 20 that spans the opening. The retainer member 32 is an extruded member having a constant profile along the full length thereof in the lateral direction of the sheet. The profile includes two channel portions 34 formed along opposing sides of the retainer member in which each channel portion comprises a hollow channel of generally circular cross-section with an interior diameter that closely matches the exterior diameter of the bead 30 at the top or bottom edge of the sheet. A slot 36 is formed at the outer side of each channel portion 34 to communicate from the interior of the hollow channel to the exterior such that the slots 36 of the two channel portions are located at diametrically opposing sides of the extruded member to face outwardly away from one another. Each slot has a dimension in the circumferential direction of the corresponding channel portion corresponding approximately to the thickness of the flexible sheet 22 so as to receive the sheet extending outwardly of the channel portion when the channel portion receives one of the beads 30 at the top or bottom edge of the flexible sheet.

The extruded member forming the retainer member 32 further includes a web portion 38 connected between the two channel portions so that the two channel portions are sufficiently spaced apart to receive a fastener penetrated through the web 38 for fastening the retainer member to the corresponding frame member of the building frame 12 so that the retainer member is fixed relative to the building frame. When provided about a single building opening, the retainer member 32 typically extends along the header at the top side of the building opening to receive the bead 30 at the top edge of the sheet therein so as to secure the top edge of the sheet relative to the frame of the building. When an additional flexible sheet 20 is used to span a second building opening above the first building opening, an additional retainer member 32 is provided to span the top side of the second opening; however the same retainer member 32 used for securing the bead 30 at the top edge of the lower sheet 20 in one of the channel portions 34 thereof also receives the bead 30 along the bottom edge of the upper flexible sheet 20 within the other channel portion 34 of the same retainer member 32.

To provide tension in the longitudinal direction by pulling longitudinally on the flexible sheet 20 in proximity to the second end thereof, a tensioning pocket 40 is formed on the inner surface of the flexible sheet 20. The pocket is formed from a fabric panel that spans laterally the full width of the sheet 20. The fabric panel is formed in a generally U-shaped loop so that opposing edges 42 of the panel are adjacent one another at the top of the loop opposite a central fold in the panel at the bottom of the loop. Each of the edges 42 spans laterally across the full width of the fabric sheet 22 be joined to the fabric sheet at a corresponding mounting location which is closer to the bottom edge of the flexible sheet 20 than the top end of the flexible sheet. The two edges 42 are stitched together and to the flexible sheet 20 by one or more rows 44 of stitching. In addition, an optional additional row 46 of stitching may be provided along an inner portion of the fabric panel forming the pocket 40 closer to the fold forming the bottom of the loop of material of the pocket 40.

A tension member 48 in the form of a rigid frame member which is hollow and tubular in shape, for example an extruded metal or plastic tube or pipe, is received within the tensioning pocket 40 to span across the full width of the flexible sheet 20 in the lateral direction, so as to span across the plurality of sheet sections 28 if more than one is provided, with a single rigid member.

A tensioning assembly is provided comprising a plurality of tensioning devices 50 coupled between the tension member 48 and the building frame along the bottom side of the building opening at a plurality of laterally spaced apart positions in the lateral direction. In the illustrated embodiment, each tensioning device 50 comprises a winch including a winch body 52 defining a bottom mounting portion of the winch which is arranged to be fixed to the building frame along the bottom side of the corresponding building opening opposite from the retainer member fixed along the top side of the building opening. Suitable fasteners can be used to extend through the winch body and into the fixed structure of the building to fix the winch body relative to the building frame.

In the usual manner of a winch, the winch body 52 supports a winch drum 54 rotatably thereon for cooperation with a releasable pawl (not shown) in the normal manner of operation of a winch. A winch strap 56 includes a first end wound onto the winch drum. The winch strap extends from the drum and passes through corresponding slots 58 formed in the fabric panel of the pocket 40 so that the strap can extend around and overtop the respective portion of the tension member 48 in alignment therewith towards an opposing second end 60 of the strap which is fixed onto the winch body using a suitable retainer pin or the like. The winches are operated to tighten the respective winch straps which pulls the tension member 48 in the longitudinal direction of the flexible sheet downward and away from the retainer member 32 securing the opposing first end of the flexible sheet therein. The flexible sheet 20 is thus effectively tensioned in the longitudinal direction between the first end 22 at the top of the sheet and the mounting location of the pocket 40 on the flexible sheet 20 in proximity to the bottom second and 24 thereof.

A remaining end portion 62 of the flexible sheet 20 is defined between the mounting location of the pocket 40 of the tension member 48 and the bottom second end 24 of the flexible sheet. The end portion 62 spans in the longitudinal direction of the sheet by an overall height of the tension assembly between the mounting location of the tension member and the bottom of the building opening. When a bottom bead is provided, the bottom edge can also be secured in fixed relation to the building frame to provide a continuous weather barrier spanning across the corresponding opening in the building.

When used at upper levels of a building structure where a safety railing is required to prevent construction workers from falling over the outer edges of the upper levels, the wall system 10 may further include a railing assembly as described in the following. The railing assembly includes a railing pocket 64 formed onto the inner surface of the flexible sheet 20. Similarly, to the tensioning pocket, the railing pocket also comprises a fabric panel spanning the full width of the flexible sheet 20 in the lateral direction thereof. Opposing top and bottom edges 66 and 68 of the fabric panel forming the railing pocket are joined to the flexible sheet using respective rows of stitching 70 or other permanent fasting means including heat welding or adhesive and the like. The fabric panel is longer between top and bottom edges than the spacing between the stitching rows 70 such that the panel is able to protrude inwardly from the inner surface of the flexible sheet 20 in a triangular shape towards an inner apex 70 so as to define a triangular shape of the hollow interior of the pocket 64 at the inner surface of the flexible sheet 20.

The railing system further includes a rigid railing member 74 in the form of a rigid, tubular frame member, for example an extruded hollow plastic or metal tube or pipe, which spans the full width of the flexible sheet 20 in the lateral direction between corresponding posts at laterally opposing sides of the corresponding building opening. Two frame mounts 76 are supported on the building posts at opposing sides of the building opening. Each frame mount includes a L-shaped bracket having a first flange joined to an inner surface of the respective post of the building frame using suitable fasteners, and a second flange extending perpendicularly and horizontally inward into the building from the building frame. Another winch 78 having a which body and winch drum as described above is mounted on the second flange using suitable fasteners to fix the winch body to the second flange of the bracket.

A tension cable 80 is provided in the form of an elongate rope or other strand material such as a steel cable, which is wound at opposing ends onto the winches 78 of the two frame mounts 76 at laterally opposing sides of the corresponding building opening. One or both winches is operated to provide tension to the cable 80 in the lateral direction. The cable 80 is inserted through the hollow interior of the rigid railing member 74 to extend longitudinally within the rigid railing member across the full length thereof in the lateral direction of the flexible sheet 20. The flexible sheet is typically supported to be substantially flush with the exterior side of the building frame while the frame mounts for the railing assembly are supported at the inner surface of the building frame such that the rigid railing member 74 supported by the tension cable 80 between the frame mounts 76 is positioned at a location spaced perpendicularly inward from the plane of the flexible sheet 20.

The flush mounting of the flexible sheet 20 with the exterior side of the building readily allows adjacent flexible sheets 20 at two adjacent building openings of the building to be joined to one another to form a continuous barrier sheet across the exterior of the building frame. Typically, the adjacent sheets are joined with releasable fasteners such as hook and loop fasteners, zippers, or laces tied between grommet openings along the side edges of the adjacent flexible sheets 20 respectively.

The fabric panel forming the railing pocket 64 includes a plurality of cut-out openings 82 formed therein at the inner apex 72 of the pocket at spaced apart positions from one another in the lateral direction of the flexible sheet so as to be spaced apart along the length of the railing member. Each cut-out opening 82 defines an access opening in alignment with the railing member to fully expose the respective portion of the railing member with additional space surrounding the railing member such that the railing member can be readily grasped in the hand of a user at each opening 82.

In use, the wall system is typically mounted onto a building frame by initially fastening the retainer member 32 across the top side of the corresponding building opening to be covered. The top edge of the flexible sheet 20 can then be inserted into a corresponding channel portion of the retainer member by sliding the bead at the top edge of the flexible sheet into the retainer member in the lateral direction of the sheet until the sheet is aligned with the building opening. If securing the bottom end of the sheet with a corresponding bead in a channel, the bottom bead is also inserted into the respective frame member along the bottom side of the corresponding building opening. The tension member 42 is then inserted into the pocket at the inner side of the flexible sheet 20 with the winch straps 56 being extended about the tension member. With the winch bodies fixed along the bottom of the building opening, further operation of the winches will pull the tension member downwardly to longitudinally tension the sheet between (i) the top first end 22 and (ii) the mounting location of the tension member in proximity to the bottom second end 24. The railing member 74 is then inserted into the railing pocket 64 and the tension cable 80 is tensioned in the lateral direction through the railing member between frame mounts 76 mounted on the building frame.

Turning now to the second embodiment according to FIGS. 6 through 10, in this instance the flexible sheet is provided for again spanning over a respective building opening in the building, however the retainer member 32 across the top side of the building opening according to the first embodiment is instead replaced with an auxiliary retainer member 100 which defines a track for supporting the flexible sheet 20 to be slidable in a lateral direction between a closed position spanning the associated building opening and an open position in which the building opening is substantially unobstructed by the flexible sheet so as to function as a doorway.

In this instance, the retainer member 100 comprises a rigid frame member in the form of a hollow tube of square cross section in which a slot 102 is formed in the bottom side of the tube to extend along the full length of the tube in the lateral direction. The slot is centred between opposing sides of the tube so as to define a pair of side flanges 104 protruding inwardly towards one another on opposing sides of the slot at the bottom wall of the tube forming the retainer member 100.

A plurality of carriage members 106 are supported within the hollow interior of the retainer member so as to be supported for sliding or rolling movement along the length of the retainer member corresponding to the lateral direction of the sheet 20. Each carriage member includes a central body 108 supporting two wheels 110 thereon at opposing sides of the body for rolling movement along respective ones of the two side flanges 104 of the retainer member. A depending hook 112 extends downwardly from the central body 108 through the bottom slot 102 for being hooked into a respective hook opening 114 in proximity to the top edge of the flexible sheet 20. A plurality of the carriage members 106 are provided at laterally spaced apart positions across the width of the sheet so as to support the sheet across the width thereof.

In further embodiments, a rigid member may be coupled to the top edge of the sheet which is in turn secured relative to the carriage members 106 using suitable hooks or fasteners of various types which communicate through the bottom slot 102 of the retainer member so as to be movable along a slot together with movement of the flexible sheet in the lateral direction relative to the track formed by the retainer member 100.

In the embodiment of FIGS. 6 through 10, the remainder of the wall system 10 is substantially identical to the previous embodiments with regard to a tensioning pocket 40 that receives a tension member 48 therein which is secured by tensioning devices 50, as well as a railing assembly comprised of a rigid railing member 74 received within a railing pocket 64. In the second embodiment however the tensioning assemblies remain readily releasable from the fabric sheet 20. In this instance, when it is desired for the door opening in the building to remain closed, the tensioning assemblies and the railing assembly remain secured between the flexible sheet and the building frame. However, when it is desired to open the door opening in the building, the tensioning assembly and the railing assembly are released so as to disconnect the flexible sheet from the building frame and support the flexible sheet 20 entirely by the carriage members 106 along the top edge thereof.

Figure 9:
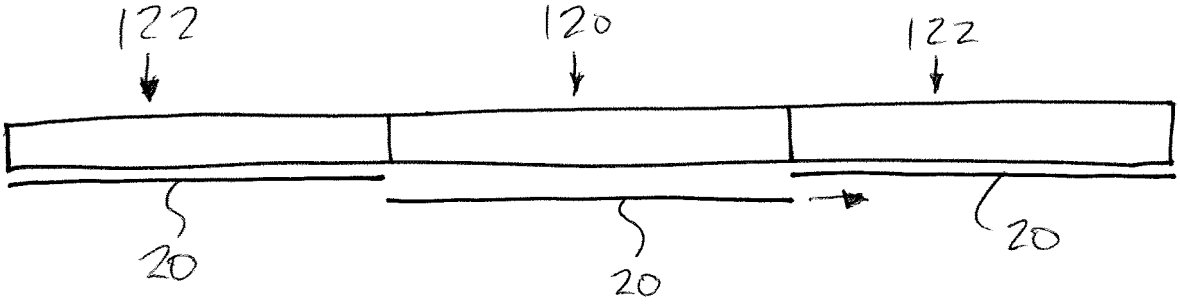
FIGS. 9 and 10 are schematic representations of the flexible sheet according to the second embodiment of FIG. 6 showing the flexible sheet in closed and open positions respectively relative to a door opening in the building, while adjacent building openings are enclosed by a flexible sheet according to the first embodiment of FIG. 1.
Figure 10:
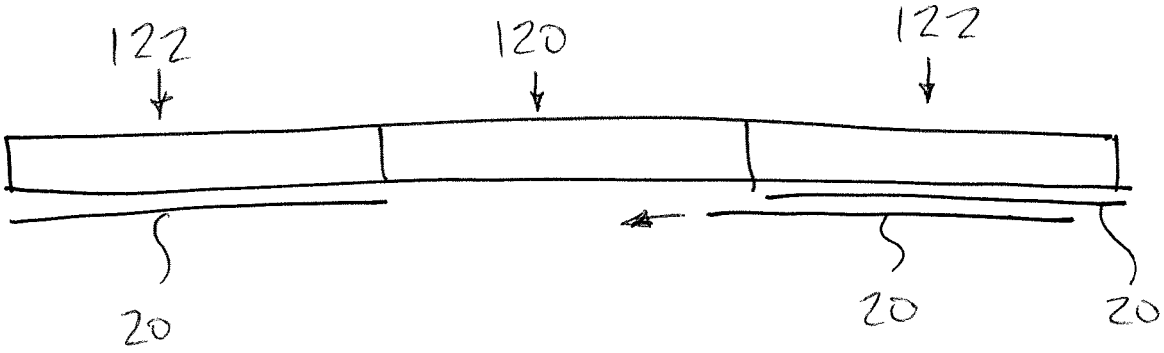

As shown in FIGS. 9 and 10, when it is desirable to form the building frame with a door opening 120 between two adjacent building openings 122 which are intended to remain closed by the wall system 10, a first flexible sheet 20 and a second flexible sheet 20 according to the first embodiment of FIGS. 1 through 5 are initially mounted in fixed relation across each of the building openings 122. The door opening 120 is instead enclosed by a flexible sheet supported on a retainer member 100 according to the embodiment of FIGS. 6 through 10.

The retainer member 100 in this instance preferably spans in the lateral direction of the sheet the full width of the door opening to be covered by the sheet as well as the full width of the adjacent building opening so that the retainer member 100 may be twice the overall length of the flexible sheet in the lateral direction. Furthermore, the retainer member 100 typically protrudes outwardly from the building by a depth which is greater than the retainer member 32 such that the movable flexible sheet according to FIGS. 6 through 10 is supported within a plane which is spaced outwardly from the building and outwardly from the plane locating other flexible sheets 20 according to the embodiment of FIGS. 1 through 5. In this instance the flexible sheet 20 that spans the door opening 120 in the closed position of FIG. 9 can be displaced in the lateral direction of the sheet to the open position of FIG. 10 in overlapping arrangement relative to a fixed one of the flexible sheets 20 over the adjacent building opening 122. The movable flexible sheet remains within a respective plane which is parallel but spaced outwardly from the plane of the flexible sheet spanning the adjacent building openings 122.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a retainer member comprising a first frame member arranged to be secured to the first end of the flexible sheet so as to span the width of the flexible sheet and arranged to mount onto the building frame in fixed relation thereto along a first end of the building opening;

a tension member comprising a second frame member arranged to be secured to the flexible sheet in proximity to the second end of the flexible sheet so as to span the width of the flexible sheet;

a pocket formed on the flexible sheet extending laterally across the width of the flexible sheet and receiving the tension member therein; and a tensioning assembly arranged to be fixed onto the building frame along a second end of the building opening opposite from the first end of the building opening, the tensioning assembly being operatively connected to the tension member so as to apply tension in the longitudinal direction to a portion of the flexible sheet between the retainer member and the tension member.

2. The system according to claim 1 wherein the second frame member forming the tension member is a rigid tube extending laterally across the width of the flexible sheet.

3. The system according to claim 1 wherein the first end of the flexible sheet comprises a bead spanning laterally across the width of the sheet and the retainer member comprises a channel adapted to retain the bead therein.

4. The system according to claim 1 further comprising a rigid railing member connected to the flexible sheet to extend in the lateral direction across the flexible sheet at an intermediate location between the first end of the flexible sheet and a connection of the tension member on the flexible sheet.

5. The system according to claim 4 wherein the rigid railing member is received within a pocket formed on the flexible sheet.

6. The system according to claim 5 wherein the pocket receives the rigid railing member therein at a location spaced from a plane of the flexible sheet.

7. The system according to claim 4 wherein the pocket includes a plurality of access openings formed therein at laterally spaced apart positions in alignment with the rigid railing member such that the rigid railing member is arranged to be grasped in a hand of a user at each access opening.

8. The system according to claim 4 wherein the rigid railing member receives a flexible cable extending through the rigid railing member in the lateral direction of the flexible sheet between opposing railing mounts, the railing mounts being arranged to be supported on the building frame so as to support the flexible cable under tension in the lateral direction transversely to the longitudinal direction of the sheet.

9. The system according to claim 1 wherein the tensioning assembly is readily releasable from the sheet and wherein the retainer member comprises a track spanning the width of the sheet and supporting one or more carriage assemblies for rolling movement in a lateral direction along the track, said one or more carriage assemblies being arranged to support the first end of the sheet thereon such that the sheet is laterally movable in the lateral direction together with rolling movement of said one or more carriage assemblies along the retainer member.

10. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a retainer member comprising a first frame member arranged to be secured to the first end of the flexible sheet so as to span the width of the flexible sheet and arranged to mount onto the building frame in fixed relation thereto along a first end of the building opening;

a tension member comprising a second frame member arranged to be secured to the flexible sheet in proximity to the second end of the flexible sheet so as to span the width of the flexible sheet; and a tensioning assembly arranged to be fixed onto the building frame along a second end of the building opening opposite from the first end of the building opening, the tensioning assembly being operatively connected to the tension member so as to apply tension in the longitudinal direction to a portion of the flexible sheet between the retainer member and the tension member;

the tension member being secured to the flexible sheet at a mounting location spaced longitudinally inwardly from the second end of the flexible sheet so as to define an end portion of the flexible sheet extending longitudinally between the mounting location and the second end of the flexible sheet which is not tensioned by the tensioning assembly.

11. The system according to claim 10 wherein the end portion of the flexible sheet spans a length of the tensioning assembly in the longitudinal direction of the flexible sheet between the tension member and a mounting portion of the tensioning assembly that is arranged to be secured to the building frame.

12. The system according to claim 10 further comprising a second retainer member comprising a third frame member arranged to be secured to the second end of the flexible sheet so as to span the width of the flexible sheet and arranged to mount onto the building frame in fixed relation thereto along the second end of the building opening.

13. The system according to claim 12 in combination with a second sheet arranged to be supported longitudinally in series with the flexible sheet, such that the second retainer member commonly secures both the second end of the flexible sheet and a first end of the second sheet therein.

14. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a retainer member comprising a first frame member arranged to be secured to the first end of the flexible sheet so as to span the width of the flexible sheet and arranged to mount onto the building frame in fixed relation thereto along a first end of the building opening;

a tension member comprising a second frame member arranged to be secured to the flexible sheet in proximity to the second end of the flexible sheet so as to span the width of the flexible sheet; and a tensioning assembly arranged to be fixed onto the building frame along a second end of the building opening opposite from the first end of the building opening, the tensioning assembly being operatively connected to the tension member so as to apply tension in the longitudinal direction to a portion of the flexible sheet between the retainer member and the tension member;

wherein the tensioning assembly comprising at least one winch arranged to be operatively connected between the building frame and the tension member.

15. The system according to claim 14 wherein said at least one winch comprises a plurality of winches at laterally spaced apart positions along the tension member.

16. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a retainer member comprising a first frame member arranged to be secured to the first end of the flexible sheet so as to span the width of the flexible sheet and arranged to mount onto the building frame in fixed relation thereto along a first end of the building opening;

a tension member comprising a second frame member arranged to be secured to the flexible sheet in proximity to the second end of the flexible sheet so as to span the width of the flexible sheet; and a tensioning assembly arranged to be fixed onto the building frame along a second end of the building opening opposite from the first end of the building opening, the tensioning assembly being operatively connected to the tension member so as to apply tension in the longitudinal direction to a portion of the flexible sheet between the retainer member and the tension member;

wherein the flexible sheet comprises a plurality of sheet sections releasably joined in series with one another using releasable fasteners such that each sheet section spans a full length of the flexible sheet in the longitudinal direction between the opposing first and second ends of the flexible sheet and only spans a portion of the width of the flexible sheet in the lateral direction; and wherein the tension member comprising a single frame member spanning the width of the flexible sheet across the plurality of sheet sections.

17. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a retainer member comprising a first frame member arranged to be secured to the first end of the flexible sheet so as to span the width of the flexible sheet and arranged to mount onto the building frame in fixed relation thereto along a first end of the building opening;

a tension member comprising a second frame member arranged to be secured to the flexible sheet in proximity to the second end of the flexible sheet so as to span the width of the flexible sheet; and a tensioning assembly arranged to be fixed onto the building frame along a second end of the building opening opposite from the first end of the building opening, the tensioning assembly being operatively connected to the tension member so as to apply tension in the longitudinal direction to a portion of the flexible sheet between the retainer member and the tension member;

wherein the flexible sheet comprises a plurality of sheet sections releasably joined in series with one another using releasable fasteners such that each sheet section spans a full length of the flexible sheet in the longitudinal direction between the opposing first and second ends of the flexible sheet and only spans a portion of the width of the flexible sheet in the lateral direction; and wherein the retainer member comprising a single frame member spanning the width of the flexible sheet across the plurality of sheet sections.

18. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a first frame member arranged to be secured to the flexible sheet in proximity to the first end of the flexible sheet so as to span the width of the flexible sheet;

a second frame member arranged to be secured to the flexible sheet in proximity to the second end of the flexible sheet so as to span the width of the flexible sheet;

the first and second frame members being arranged to mount onto the building frame in fixed relation thereto along opposing first and second ends of the building opening such that the flexible sheet is under tension in the longitudinal direction between the first and second frame members; and a rigid railing member connected to the flexible sheet to extend in the lateral direction across the flexible sheet at an intermediate location between a connection of the flexible sheet to the first frame member and a connection of the flexible sheet to the second frame member;

the rigid railing member being received within a pocket formed on the flexible sheet; and the pocket receiving the rigid railing member therein at a location spaced from a plane of the flexible sheet.

19. A wall system for spanning a building opening in a building frame of a building, the wall system comprising:

a flexible sheet of flexible material spanning in a longitudinal direction between opposing first and second ends and defining a width in a lateral direction perpendicular to the longitudinal direction between opposing side edges of the flexible sheet;

a first frame member arranged to be secured to the flexible sheet in proximity to the first end of the flexible sheet so as to span the width of the flexible sheet;

a second frame member arranged to be secured to the flexible sheet in proximity to the second end of the flexible sheet so as to span the width of the flexible sheet;

the first and second frame members being arranged to mount onto the building frame in fixed relation thereto along opposing first and second ends of the building opening such that the flexible sheet is under tension in the longitudinal direction between the first and second frame members;

a rigid railing member connected to the flexible sheet to extend in the lateral direction across the flexible sheet at an intermediate location between a connection of the flexible sheet to the first frame member and a connection of the flexible sheet to the second frame member;

the rigid railing member receiving a flexible cable extending through the rigid railing member in the lateral direction of the flexible sheet between opposing railing mounts; and the railing mounts being arranged to be supported on the building frame so as to support the flexible cable under tension in the lateral direction transversely to the longitudinal direction of the sheet.

* * * * *